United States Patent [19]

Vaughan

[11] Patent Number: 4,785,708

[45] Date of Patent: Nov. 22, 1988

[54] PICK HOLDER FOR STRINGED INSTRUMENTS

[76] Inventor: Stephen Vaughan, 16185 Alcima Ave., Pacific Palisades, Calif. 90272

[21] Appl. No.: 946,600

[22] Filed: Dec. 24, 1986

[51] Int. Cl.[4] ..... G10D 3/16

[52] U.S. Cl. ..... 84/329; 84/322; 84/453

[58] Field of Search ..... 84/322, 329, 453

[56] References Cited

U.S. PATENT DOCUMENTS

| | | | |
|---|---|---|---|
| 3,181,410 | 5/1965 | Phillips | 84/322 |
| 3,752,029 | 8/1973 | Watrous | 84/329 |
| 4,084,477 | 4/1978 | Dominguez | 84/327 |
| 4,135,431 | 1/1979 | Ferguson | 84/329 |
| 4,467,693 | 8/1984 | Nasfell | 84/329 |
| 4,567,807 | 2/1986 | Robinson | 84/411 M |

*Primary Examiner*—Lawrence R. Franklin

*Attorney, Agent, or Firm*—Poms, Smith

[57] ABSTRACT

A pick holder for a guitar is mounted in a cradle portion of a side wall of a guitar and contains a strip having a plurality of pick-receiving pockets. The pick holder has a first fastening portion affixed to the guitar body and a second fastening portion containing the pick-receiving pockets. The two fastening portions enable the strip of pick-receiving pockets to be detachably fastened to the guitar body.

10 Claims, 1 Drawing Sheet

Fig. 1.
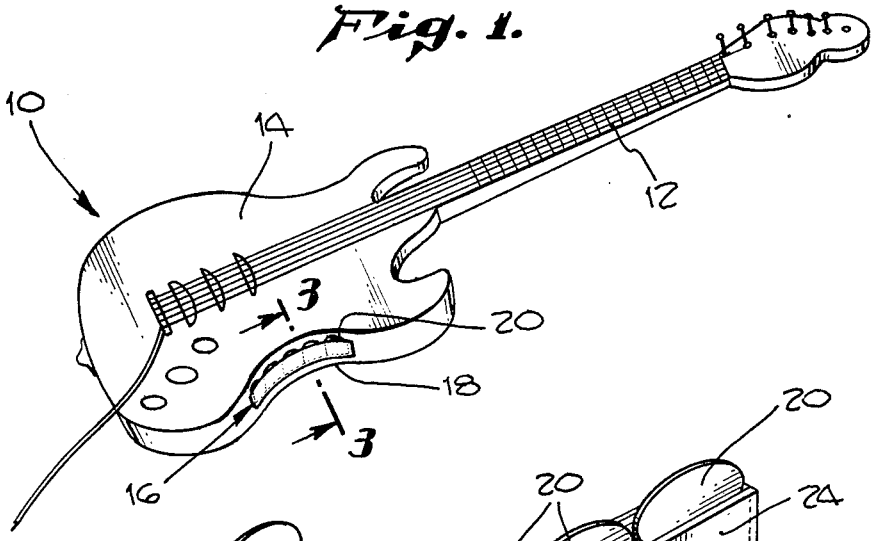
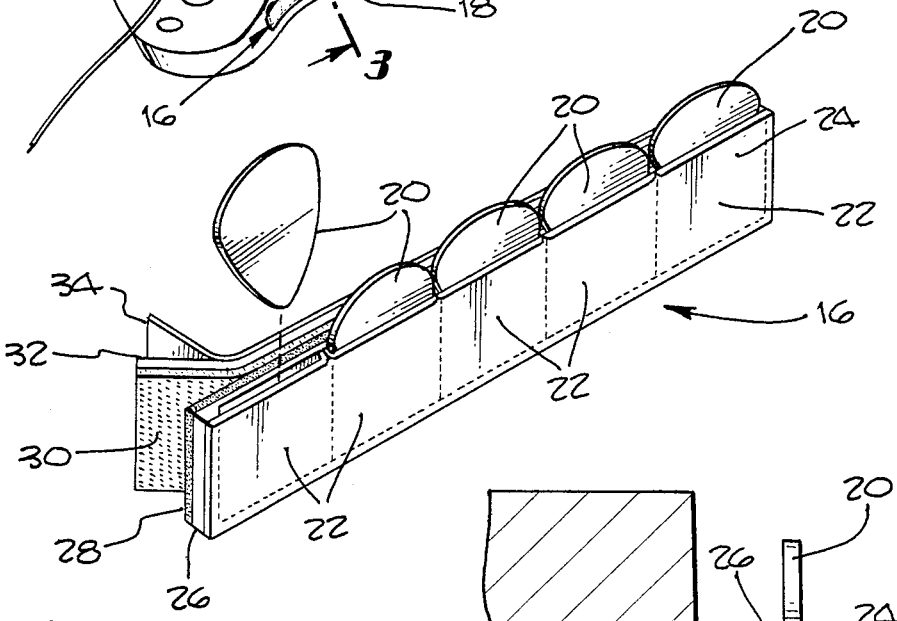
Fig. 2.
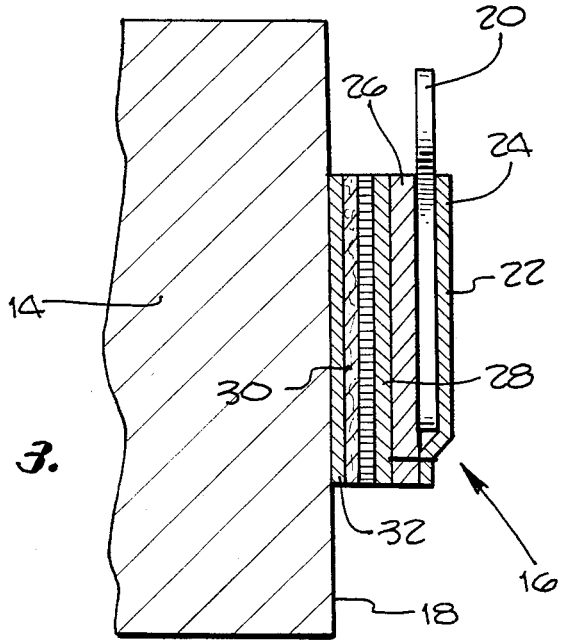
Fig. 3.

PICK HOLDER FOR STRINGED INSTRUMENTS

FIELD OF THE INVENTION

The present invention pertains to a pick holder for stringed instruments, and more particularly to a pick holder, in strip form, for attachment to a guitar.

BACKGROUND OF THE INVENTION

A number of pick holding devices are known. U.S. Pat. No. 4,135,431 (Ferguson) discloses a pick dispenser for a stringed musical instrument which includes a resilient sponge rubber material mounted in the housing of the pick dispenser to urge a pick upwardly toward an opening in the housing. The Ferguson device is a pick dispenser rather than a pick holder and consequently involves counteracting forces on the picks housed therein which may result in jamming. In addition, this pick dispenser is mounted on the face of the guitar and includes only one pick holding compartment.

U.S. Pat. No. 3,752,029 (Watrous) discloses a pick holder which employs a coiled spring for holding the pick. this pick holder is complicated in structure and includes undesirable protruding elements.

Additional problems with prior art pick holders include their lack of aesthetic appeal, their being mounted on the guitars in a permanent fashion, and that picks may potentially shake loose therefrom.

SUMMARY OF THE INVENTION

The primary object of the present invention is to overcome problems encountered with prior art pick holders by providing a simple, side-mounted, holster-style pick holder. The present pick holder includes a series of strip-holding compartments providing excellent pick storage capacity. It provides a simple design which is aesthetically appealing, securely maintaining picks in the compartments thereof. Moreover, the present pick holder contains a detachable mounting feature allowing permanent or semi-permanent attachment of a fastening portion to the guitar body and detachable mounting of an element having pick-receiving pockets thereto. The present pick holder is particularly adapted for rapid access should a pick be dropped during a performance. These and other objects and advantages will be evident from the detailed description which follows and is to be read in conjunction with the drawings.

BRIEF DESCRIPTION OF THE DRAWINGS

FIG. 1 is a perspective view of a guitar having the pick holder of the present invention mounted thereon.

FIG. 2 is a close-up perspective view of the pick holder illustrating the various elements thereof.

FIG. 3 is a section view taken along line 3—3 of FIG. 1.

DETAILED DESCRIPTION OF THE PREFERRED EMBODIMENT

FIG. 1 illustrates a guitar 10 having a neck 12 and a body 14. A pick holder 16 is mounted in a cradle position 18 of the guitar body. The guitar is preferably a solid body electric guitar (as shown); however the present invention is adapted for use with all guitar body styles, both electric and acoustic. Mounting of pick holder 16 in the cradle portion 18 of the guitar provides quick access to the picks. This feature is important in the event that a pick is dropped during a performance.

The holster style of the pick holder enables a replacement pick to be obtained within a couple of beats of the rhythm being played, minimizing any break in the flow of the music. The picks are place closely enough to the edge of the guitar body so that they may be "plucked" from the holder between the thumb and forefinger. In addition, a cradle mounting maintains the face of the guitar free from distracting or interfering elements, allowing maximum freedom and safety of hand movement. The strip style pick holder nestles into the cradle portion 18 to maximize the increased surface area at the cradle and to provide an aesthetically pleasing appearance. Five picks 20 are held in five adjacent pick-holding pockets 22 in the embodiment shown. The present design affords a secure grip on the picks, so that they are maintained securely in place despite the guitar being shaken or handled vigorously during the course of a performance.

FIG. 2 is a close-up view in perspective of the pick holder illustrating the preferred elements thereof. The elements include a facing strip 24 have pockets 22. The facing strip is preferably composed of a suitably-colored leather to provide a secure holding means which is aesthetically appealing. The facing strip in the embodiment shown is sewn to a substrate portion 26 in a manner which defines pockets 22. The substrate may be composed of any suitable material; in a preferred embodiment, it is composed of a wood fiber material such as paperboard.

In the embodiment shown, elements 28 and 30 are mating strips of a Velcro fastener, strip 28 being affixed to the substrate 26, preferably by gluing, and strip 30 being removably afffixed to strip 28. In the embodiment shown, elements 24, 26, 28 and 30 are all substantially equal in their dimensions to provide a four-layered rectangular-shaped device.

In the preferred embodiment, an adhesive strip 32 is affixed to Velcro strip 30, the adhesive strip being adapted to be adhered to the guitar body. A peelable backing strip 34 covers the adhesive layer. Backing strip 34 is peeled away prior to affixing the adhesive layer to the guitar body. Adhesive strip 32 will not harm the finish of guitar body 14 when affixed thereto. When it is decided exactly where to position the pick holder, a Velcro piece equivalent to Velcro strip 30 may be glued to the guitar body in a more permanent fashion.

FIG. 3 is a section view of the pick holder of the present invention taken along lines 3—3 of FIG. 1. Adhesive section 32 is attached to guitar body 14. Velcro sections 28 and 30 are attached, and substrate portion 26 is sewn to facing strip 24 by stitching 36 and retains pick 20 therebetween.

I claim:

1. A pick holder for a stringed musical instrument comprising:

a flexible body having a plurality of pick storage pockets, said body having a flexibility sufficient to conform to the contours of the body of the stringed musical instrument, each pick storage pocket having a slot-like receiving portion for receiving a pick, the receiving portion being dimensioned to cover a substantial portion of a pick while providing another portion of the pick uncovered on both a first and a second side of said pick to enable grasping thereof;

a means for removably fastening said flexible body to the musical instrument body, said means for fastening being thick enough to allow a sufficient clearance between the body of the stringed musical instrument and each pick when stored in said pick storage pockets so that each said pick may be readily grasped by the thumb and forefinger of a user.

2. A pick holder for a stringed musical instrument comprising:

a flexible body having a plurality of pick storage pockets, said body having a flexibility sufficient to conform to the contours of the body of the stringed musical instrument, each pick storage pocket having a slot-like receiving portion for receiving a pick, the receiving portion dimensioned to cover a substantial portion of a pick while providing another portion of the pick uncovered on both a first and a second side of said pick so that said pick may be readily grasped;

a first fastening portion affixed to at least one pick storage pocket; and a second fastening portion, having means for affixation to a the body of the musical stringed instrument and adapted to be detachably fastened to the first fastening portion, said first and second fastening portions being thick enough to allow a sufficient clearance between the body of the stringed musical instrument and each pick when stored in said pick storage pockets so that each said pick may be readily grasped by the thumb and forefinger of a user.

3. A pick holder according to claim 2, wherein the first and second fastening portions are first and second elements respectively of a Velcro fastener.

4. A pick holder according to claim 2 wherein each of said pick storage pockets is defined by an outer facing strip affixed to an inner substrate strip and wherein the facing strip, substrate strip, and first and second fastening portions each comprise a rectangular-shaped strip of substantially equal size.

5. A pick holder according to claim 4 wherein the facing strip and the substrate strip are affixed by stitching therebetween.

6. A pick dispenser according to claim 5 wherein the facing strip is composed of leather and the substrate is composed of a paperboard material.

7. A pick holder according to claim 2 wherein the slot-like receiving portion contains a substantially flat pick therein.

8. A pick holder according to claim 7 wherein the pick contains a relatively wide upper portion and a relatively narrow lower portion and the lower portion is covered by said pick storage pocket while the upper portion is uncovered.

9. A pick holder according to claim 2 further comprising an adhesive layer affixed to the second fastening portion and comprising the means for affixation to a guitar body.

10. A pick holder according to claim 9 further comprising a paper backing on the adhesive strip adapted to be peeled off prior to affixation of the adhesive strip to a guitar body.

* * * * *